US010411363B2

(12) United States Patent
Ceely et al.

(10) Patent No.: US 10,411,363 B2
(45) Date of Patent: Sep. 10, 2019

(54) FOLDABLE DIPOLE ARRAY ANTENNAS

(71) Applicant: The Boeing Company, Chicago, IL (US)

(72) Inventors: William J. Ceely, Fontana, CA (US); Tom M. Hikido, Torrance, CA (US); John E. Baldauf, Redondo Beach, CA (US); Miguel A. Estevez, Los Angeles, CA (US)

(73) Assignee: THE BOEING COMPANY, Chicago, IL (US)

( * ) Notice: Subject to any disclaimer, the term of this patent is extended or adjusted under 35 U.S.C. 154(b) by 155 days.

(21) Appl. No.: 15/595,143

(22) Filed: May 15, 2017

(65) Prior Publication Data

US 2018/0331433 A1 Nov. 15, 2018

(51) Int. Cl.

| | |
|---|---|
| ***H01Q 1/36*** | (2006.01) |
| ***H01Q 21/26*** | (2006.01) |
| ***H01Q 1/08*** | (2006.01) |
| ***H01Q 1/28*** | (2006.01) |
| ***H01Q 11/10*** | (2006.01) |
| ***H01Q 25/00*** | (2006.01) |

(52) U.S. Cl.

CPC ..... *H01Q 21/26* (2013.01); *H01Q 1/08* (2013.01); *H01Q 1/084* (2013.01); *H01Q 1/288* (2013.01); *H01Q 11/10* (2013.01); *H01Q 25/001* (2013.01)

(58) Field of Classification Search

CPC ..... H01Q 21/26; H01Q 1/08; H01Q 1/288; H01Q 11/10; H01Q 25/001

See application file for complete search history.

(56) References Cited

U.S. PATENT DOCUMENTS

| | | | | |
|---|---|---|---|---|
| 2,569,810 | A | 10/1951 | Hamel et al. | |
| 3,579,244 | A | 5/1971 | Dempsey et al. | |
| 3,587,104 | A * | 6/1971 | Budrow | H01Q 1/1235 343/704 |
| 3,717,879 | A * | 2/1973 | Ganssle | H01Q 15/162 343/915 |
| 4,262,293 | A | 4/1981 | Partner | |
| 7,354,033 | B1 | 4/2008 | Murphey et al. | |
| 2009/0033578 | A1 * | 2/2009 | Martek | H01Q 9/28 343/773 |

OTHER PUBLICATIONS

Piovesan et al., "Design and Validation of a Carbon-Fiber Collapsible Hinge for Space Applications: A Deployable Boom", Journal of Mechanisms and Robotics, Dec. 2015 (35 pages).

* cited by examiner

*Primary Examiner* — Dieu Hien T Duong
(74) *Attorney, Agent, or Firm* — Hanley, Flight & Zimmerman, LLC

(57) ABSTRACT

Foldable dipole array antennas are disclosed. A disclosed example apparatus includes a helical communication line of a dipole array antenna, and hinges spaced along the helical communication line. The apparatus also includes dipole branches operatively coupled to the helical communication line, where the dipole branches are to be moved, at the hinges, between deployed and un-deployed states.

26 Claims, 9 Drawing Sheets

FOLDABLE DIPOLE ARRAY ANTENNAS

STATEMENT REGARDING FEDERALLY SPONSORED RESEARCH OR DEVELOPMENT

This disclosure was made with Government support under contract number FA8807-16-C-0003 awarded by The Department of Defense. The Government of the United States may have certain rights in this disclosure.

FIELD OF THE DISCLOSURE

This disclosure relates generally to antennas and, more particularly, to foldable dipole array antennas.

BACKGROUND

Known dipole array antennas, such as logarithmic dipole array antennas and/or log-periodic arrays, are often associated with transmission or reception of relatively large transmission bandwidth radio frequency (RF) signals. These known dipole array antennas usually consist of repeating patterns of dipole branches or elements that extend in diametrically opposite directions as repeating branch pairs from a central or primary branch (e.g., a central spine, etc.).

In some known examples, such dipole branches are folded out from a respective primary branch to deploy the dipole branches to receive or transmit signals. Some known dipole array antennas employed on satellites include multiple support branches having an RF communication line (e.g., an RF transmit/receive cable assembly or wire), which may be coupled to multiple dipole branches, in an arrangement in which the communication line zig-zags back and forth between different dipole branches. However, such arrangements make it difficult to align dipole branches of a corresponding pair due to this zig-zagging of the transmission line and/or the numerous associated support structures, thereby causing potential RF performance degradation. Further, these support structures (e.g., at least two support poles for each dipole branch pair) can have significant associated costs and/or design complexity.

SUMMARY

An example apparatus includes a helical communication line of a dipole array antenna, and hinges spaced along the helical communication line. The apparatus also includes dipole branches operatively coupled to the helical communication line, where the dipole branches are to be moved, at the hinges, between deployed and un-deployed states.

An example satellite includes a dipole array antenna having intertwined helical communication lines surrounding a central support, where electrically conductive hinges are spaced along the intertwined helical communication lines. The example satellite also includes dipole branches operatively coupled to the helical communication lines and a movement device to move, at the hinges, the dipole branches between deployed and un-deployed states.

An example method includes rotating at least a portion of a dipole branch about a hinge to stow or deploy the dipole branch, where the dipole branch is operatively coupled to a helical communication line of a dipole array antenna.

Another example method includes transmitting or receiving signals via helical communication lines of a dipole array antenna, where the helical communication lines are operatively coupled to dipole branches, and where the dipole branches are foldable at respective hinges spaced along the helical communication lines.

Figure 1:
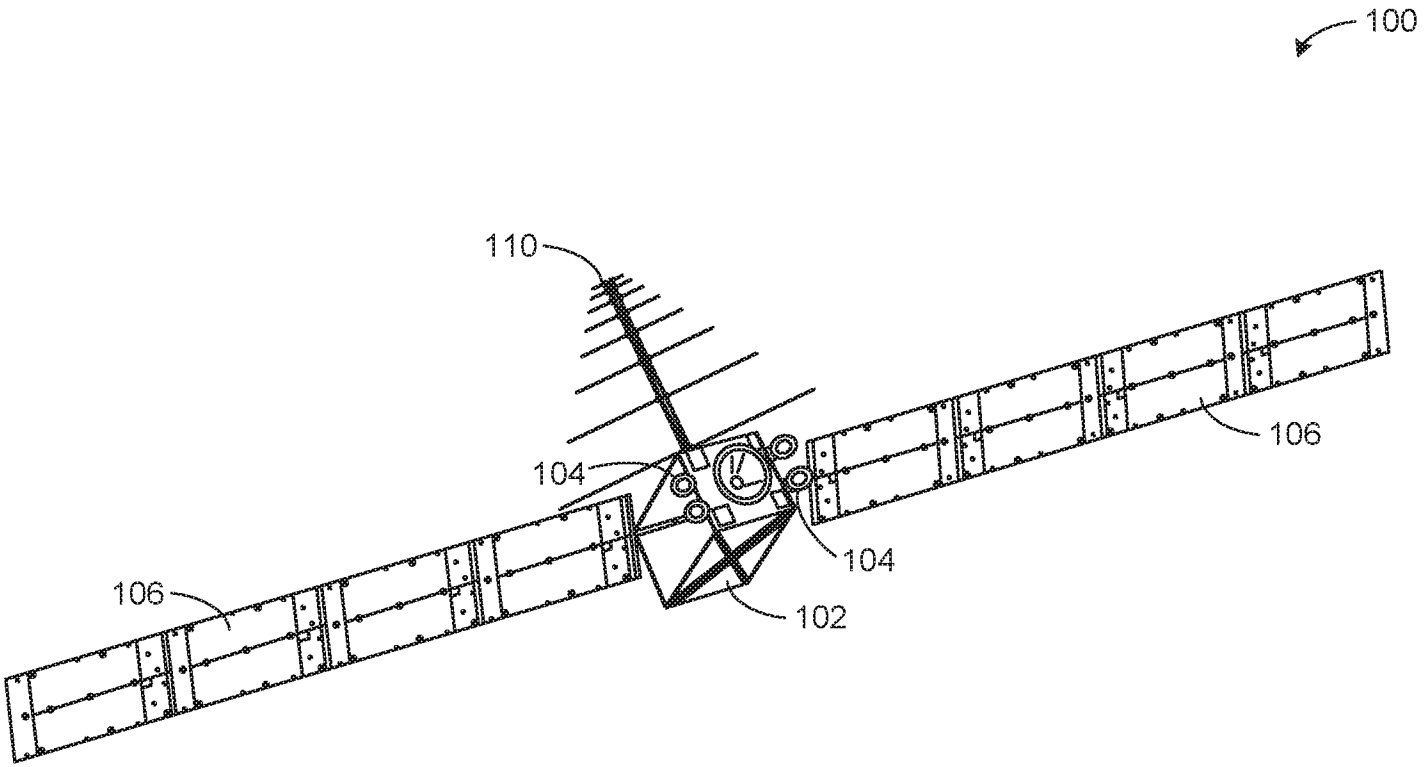
FIG. 1 is a known satellite in which the examples disclosed herein may be implemented.

The figures are not to scale. Instead, to clarify, multiple layers and regions, the thickness of the layers may be enlarged in the drawings. Wherever possible, the same reference numbers will be used throughout the drawing(s) and accompanying written description to refer to the same or like parts. As used in this patent, stating that any part is in any way positioned on (e.g., positioned on, located on, disposed on, or formed on, etc.) another part, means that the referenced part is either in contact with the other part, or that the referenced part is above the other part with one or more intermediate part(s) located therebetween. Stating that any part is in contact with another part means that there is no intermediate part between the two parts.

DETAILED DESCRIPTION

Foldable dipole array antennas are disclosed. In some known dipole array antennas, dipole branches or elements that define dipole branch pairs are folded out from a primary support branch to deploy the dipole branches so that signals may be received and/or transmitted. Some known dipole array antennas employed on satellites include a primary support (e.g., a primary support branch) to support and align the dipole branches relative to one another. The primary supports usually have an associated transmission line that zig-zags between different dipole branches.

Typically, multiple transmission lines are used and multiple dipole branches are coupled to the transmission lines along their respective lengths. However, such arrangements make it difficult to align dipole branch pairs of a corresponding pair due to the zig-zagging of the transmission lines and the interplay between the numerous transmission lines. Further, support structures often implemented to align the dipole branch pairs require significant complexity and/or cost to reduce misalignment of dipole branch pairs (e.g., at least two support poles for multiple sets dipole branch pairs). This misalignment of the dipole branch pairs can result in reduced radio frequency (RF) performance. Further, assembling multiple different support structures to align multiple dipole branches in different orientations often involves significant design/tolerance complexity and a relatively large number of supporting components, which can have significant associated costs (e.g., parts costs, manufacturing costs, labor costs, etc.).

The examples disclosed herein enable space-saving and cost-effective foldable dipole array antennas. The examples disclosed herein utilize a helical communication line or cable of a dipole array antenna that is operatively coupled to a hinge or joint. The hinge causes and/or enables a dipole branch to rotate and/or deploy for use. According to the examples disclosed herein, at least a portion of the dipole branch may be rotated and/or folded by use of a movement/restraint device (e.g., an actuator). In particular, a cable of the movement/restraint device may be used to displace and/or allow the dipole branch to rotate about the hinge so that the dipole branch can be moved between folded (i.e., stowed) and unfolded (i.e., deployed) states (e.g., folded and unfolded positions). Further, the examples disclosed herein may enable improved RF performance by enabling precise alignment of dipole branches.

In some examples, the helical communication line surrounds and/or wraps around a support (e.g., a central support, a center support, a central structure, etc.), which may be generally cylindrical in shape (e.g., a hollow cylinder). In some examples, a tape spring hinge is implemented to rotate the dipole branch. In such examples, the tape spring hinge may be moved via cables of a movement device. Additionally or alternatively, the hinge is electrically conductive.

As used herein, the term "hinge" refers to any mechanical and/or electrical device that enables rotational movement of a first component relative to a second component, and vice-versa. Accordingly, the term "hinge" may refer to a hinge, a hinged joint, a rotational elbow, an actuated elbow, a leaf spring, a swivel joint, etc. As used herein, the term "communication line" refers to a cable, wire and/or cable assembly used to convey and/or propagate a signal, which may be a transmission signal or a received signal.

As used herein, the term "helical" refers to a helix and/or helix-like structure exhibiting helical characteristics along at least one direction or axis. Accordingly, the term "helical" may refer to a helical and/or winding structure that exhibits helical characteristics along multiple axes or directions. Further, the term "helical" may also refer to a portion of a component exhibiting helical characteristics. As used herein, the term "spaced along" can generally mean spaced relatively to (e.g., spaced relatively to a length and/or span, etc.) does not necessarily mean directly coupled to. As used herein, the term "operatively coupled" can refer to being indirectly coupled to (i.e., intervening components and/or features therebetween, etc.) does not necessarily mean coupled directly to.

FIG. 1 is a known satellite 100 in which the examples disclosed herein may be implemented. The satellite 100 of the illustrated example includes a satellite body 102, which includes on-board processors, control circuitry, batteries and/or fuel tanks, thrusters 104, solar panels 106, and an antenna (e.g., an antenna array, communication antennae, etc.) 110.

In operation, the satellite 100 may communicate with external systems (e.g., transmit as well as receive) via the antenna 110 to maneuver and/or to provide data to external ground-based systems, for example. Accordingly, the satellite 100 deploys and/or stows the antenna 110 based on whether the satellite 100 requires communication (e.g., space-based communication, planetary communication, etc.).

The examples disclosed herein allow the satellite 100 to effectively reduce a storage or stowage volume needed to stow an array antenna as well as weight associated with known dipole array antenna designs. In particular, the examples disclosed herein allow for reliable, space-efficient and cost-effective dipole array structures that may result in a higher degree of symmetry between dipole branches and, thus, improve RF performance.

Figure 2:
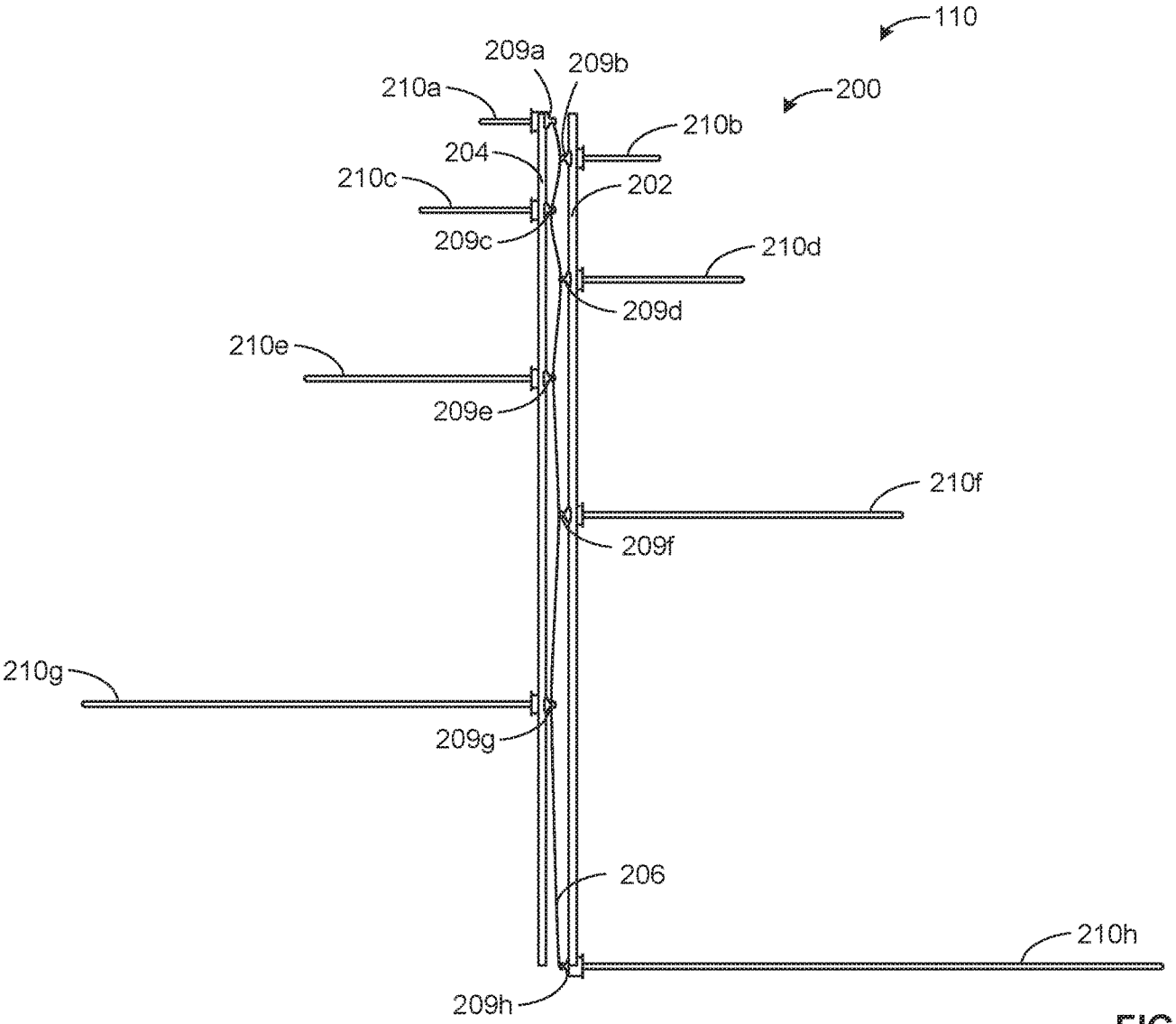
FIG. 2 illustrates a branch of a known example dipole array antenna of the satellite of FIG. 1.

FIG. 2 illustrates a branch (e.g., a node, transmission branch, etc.) 200 of the known dipole array antenna 110 of the satellite 100 shown in FIG. 1. The branch 200 of the illustrated example includes a first central support 202, a second central support 204 that is substantially parallel to the first central support 202, and an RF communication line 206. The example branch 200 also includes coupling points (e.g., electrical coupling points, mechanical coupling points, joints, etc.) 209 (hereinafter shown as 209*a*-209*h*), and dipole branches (e.g., antenna pair portions, antenna array branches, etc.) 210 (hereinafter shown as 210*a*-210*h*).

To define a dipole array antenna, multiple (e.g., two, four) branches 200 are placed proximate one another such that the dipole branches 210 are each arranged in opposing repeating pairs. In this example, the dipole branches 210 have varying lengths relative to one another.

To electrically couple the transmission line 206 to the dipole branches 210*a*-210*g*, the transmission line 206 is split at the respective coupling points 209*a*-209*g*. As can be seen in FIG. 2, the transmission line 206 generally extends along longitudinal lengths of the central supports 202, 204 in a zig-zag pattern so that the transmission line 206 can be coupled at the different alternating coupling points 209*a*-209*h*. This complex path of the transmission line 206 can complicate assembly or operation of the dipole array antenna 110. Further, folding of the branch 200 and/or the corresponding dipole array antenna 110 may be difficult and/or relatively complex, thereby requiring numerous components and their associated costs.

Figure 3:
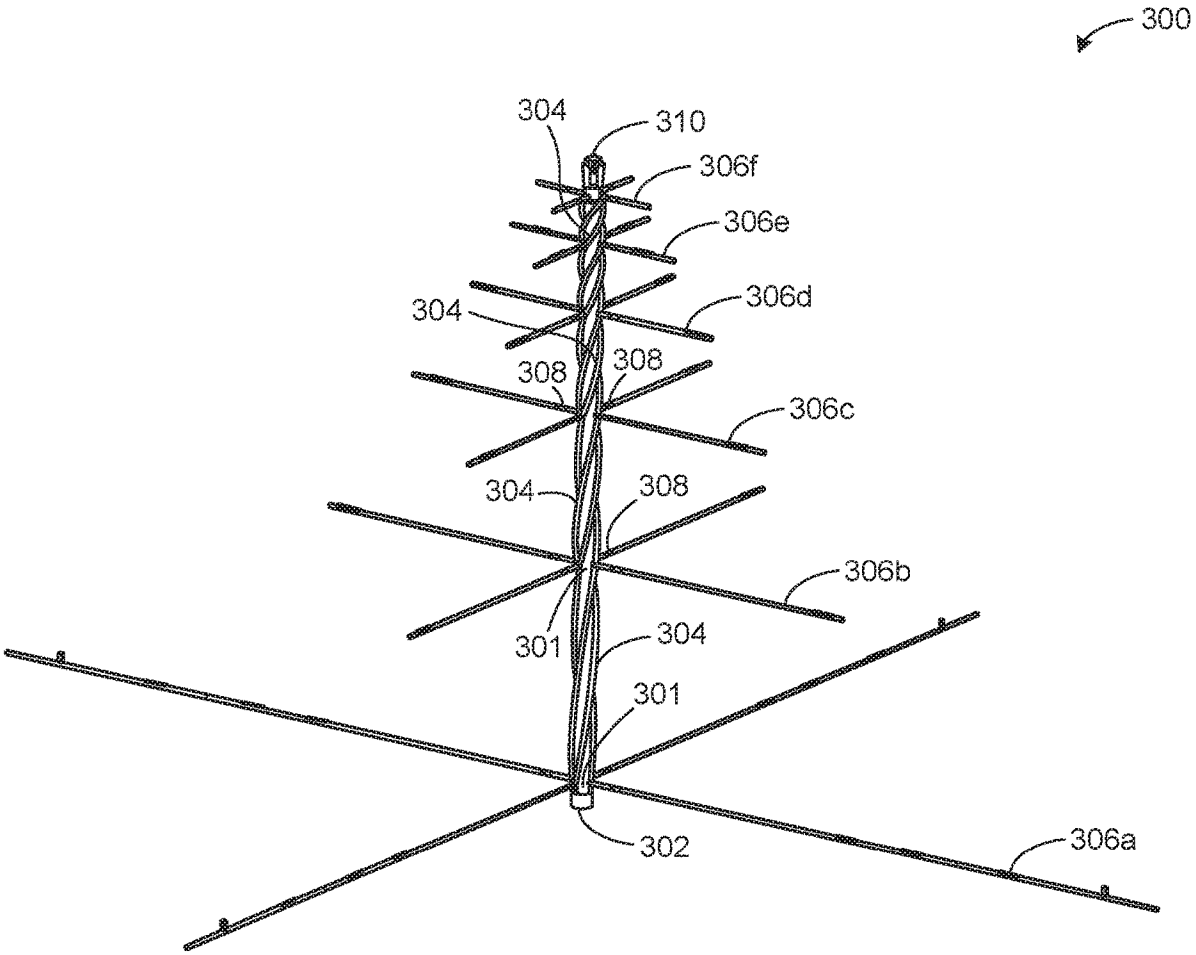
FIG. 3 illustrates an example dipole array antenna in accordance with the teachings of this disclosure and shown in a deployed state.

FIG. 3 illustrates an example dipole array antenna 300 in accordance with the teachings of this disclosure. According to the illustrated view of FIG. 3, the dipole array antenna 300 is shown deployed. The dipole array antenna 300 of the illustrated example includes a support (e.g., a central support, a central cylinder, etc.) 301, a base or mount 302, helical communication lines (e.g., wired transmission lines, transmission wires, signal cabling, etc.) 304, and dipole branches (e.g., foldable dipole branches, foldable dipole arms, etc.) 306 (hereinafter 306*a*-306*f*) that are coupled (e.g., electrically and/or mechanically coupled) to the respective helical communication lines 304 via coupling points 308. In some examples, the antenna array 300 includes a movement or restraint system (e.g., a pyrotechnic device, an actuation system, a movement system, etc.) 310, which is described in greater detail below in connection with FIGS. 4 and 8.

To support and align the dipole branches 306 in positions and/or orientations relative to the helical communication lines 304 to facilitate RF communication, the support 301 is surrounded by, wrapped by and/or coupled to the helical communication lines 304. In particular, the helical communication lines 304 extend along a longitudinal length of the support 301, which is implemented as a cylindrical tube in this example, in a generally twisting and intertwined configuration, thereby saving space while allowing the dipole branches to be accurately arranged in a pattern of opposing pairs along the length of the support 301. In this example the support 301 is at least partially composed of fiberglass. However, any other appropriate material may be used.

In this example, the helical communication lines 304 are coupled to the support 301 at or proximate the coupling points 308. In other words, the helical communication lines 304 are coupled and/or constrained to the support 301 at multiple points. In some examples, the helical communication lines 304 are coupled to the support 301 along nearly their entire respective lengths. Additionally or alternatively, the support 301 supports and/or is coupled to the coupling points 308. In such examples, the helical communication lines 304 may be relatively independent of the central support 301 (e.g., not coupled to the support 301), but coupled to the coupling points 308.

To define multiple opposed dipole branches and, thus, a dipole array, the coupling points 308 are arranged diametrically opposed to one another. In this example, at each position along the length of (upward in the view of FIG. 3) of the support 301, there are four opposing dipole branches 306 (e.g., two opposing pairs at each vertical height interval) that extend laterally from the support 301 (e.g., perpendicular to a central axis of the support 301). The example dipole branches 306 are spaced apart approximately 90 degrees from one another. However, in other examples, the dipole branches 306 may be arranged in a different radial pattern (e.g., six dipole branches 306 are spaced apart at 60 degree intervals, etc.).

In some examples, the base 302 is displaced to move the dipole array antenna 300 between stowed and deployed states. In particular, the base 302 may be moved to place the dipole array antenna 300 in a storage and/or storage volume. In such examples, the dipole branches 306 are folded inward towards the support 301, thereby causing distal ends of the dipole branches 306 to be relatively close to the support 301. In some examples, the dipole branches 306 are curved and/or at least partially define a curve that extends from the respective helical communication line 304.

While four helical communication lines 304 are shown in the illustrated example of FIG. 3, any appropriate number of the helical communication lines 304 may be used (e.g., two, three, ten, twenty, etc.). For example, six of the helical communication lines 304 may be used to define six opposing dipole branches that may be angled at 60 degree intervals from one another. In some examples, the communication lines 304 extend along the longitudinal length of the support 301 in a relatively different curvature and/or helical shape (e.g., uneven curvature along the length of the support 301, etc.). In some examples, distances between sets of the dipole branches 306 varies along the length of the support 301.

In some other examples, the communication lines 304 are imprinted onto the support 301. For example, the communication lines 304 may be defined onto the support 301 via a lithography, deposition, printing and/or etching process. In other examples, the communication lines 304 and/or conductors of the communication lines 304 may be molded and/or co-molded with the support 301.

Figure 4:
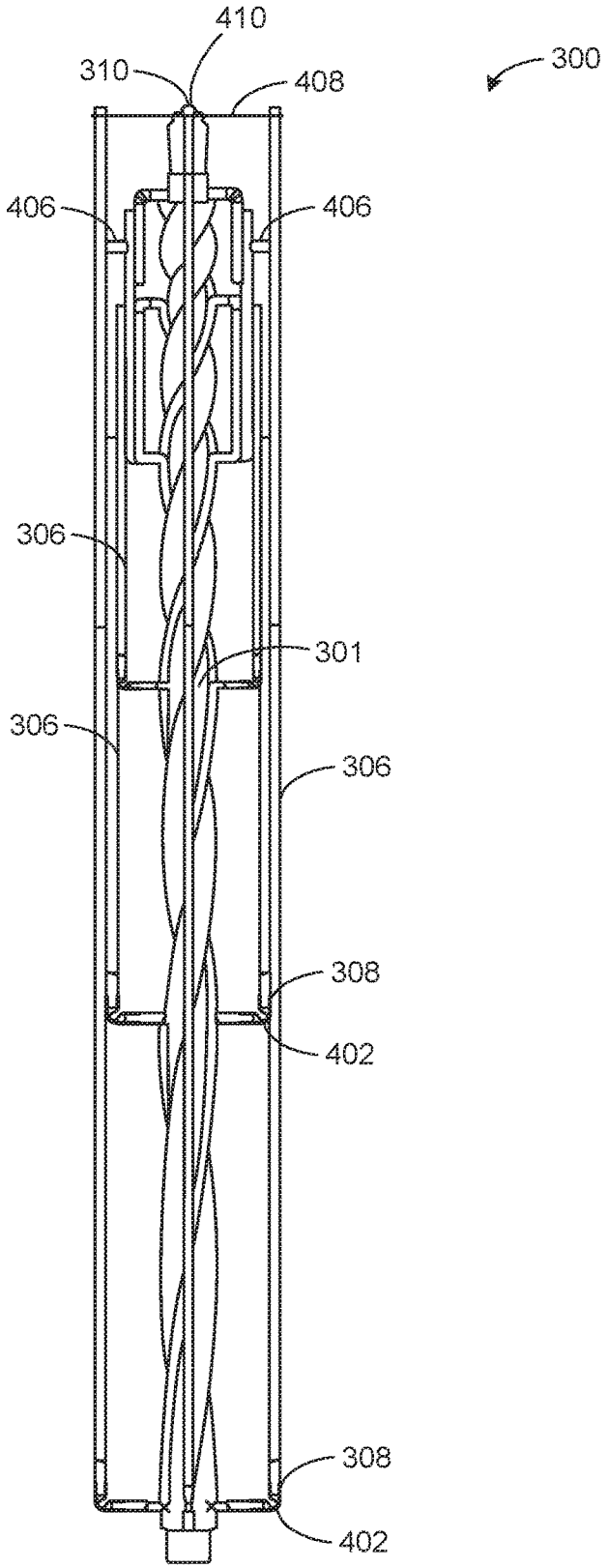
FIG. 4 illustrates the example dipole array antenna of FIG. 3, but with dipole branches shown stowed instead of deployed.

FIG. 4 illustrates the example dipole array antenna 300 of FIG. 3, but with the dipole branches 306 shown stowed instead of deployed. According to the illustrated example of FIG. 4, the dipole branches 306 are folded towards the support 301, thereby defining a compact structure, which can be stored in a relatively small volume. As can be seen in FIG. 4, the dipole array antenna 300 has joints or hinges (e.g., rotatable joints, actuated hinges, etc.) 402 at the respective coupling points 308 as well as spacers 406 that are coupled to the respective dipole branches 306, thereby aligning the dipole branches 306 relative to one another in a space-efficient manner when the dipole array antenna 300 is folded to prevent the dipole branches 306 from being misaligned, stressed or bent. In this example, the dipole array antenna 300 also includes a cable (e.g., a tension cable, a movement cable, a pulley cable, etc.) 408 that is moved and/or extended outward (e.g., away from) from the movement/restraint device 310, which is located proximate a distal end 410 of the support 301 and the dipole array antenna 300 in this example.

To move the dipole array antenna 300 between deployed and un-deployed states by rotating the dipole branches 306 at their respective hinges 402, the restraint device 310 of the illustrated example allows the cable 408 to be extended away from (and downward in the view of FIG. 4) the movement device 310. In particular, the movement device 310 may allow the cable 408 to extend away from a spool in which a portion of the cable 408 is wound. In this example, the hinges 402, which are implemented as tape spring hinges, each have a default unfolded or extended state and releasing the cable 408 allows the hinges 402 to move toward their respective default unfolded states.

In some other examples, the dipole branches 306 are not rotated by the movement/restraint system 310. In such examples, the hinges 402 may be implemented as a rotatable joint (e.g., a foldable elbow, a pivot joint) that may be actuated, self-rotating and/or coupled to a movement element (e.g., a cable, a spring, a mechanical linkage, etc.), which rotates or folds the respective dipole branch 306. Additionally or alternatively, the hinges 402 include or are operatively coupled to motors, solenoids and/or other rotational movement devices.

In some examples, at least a portion of (e.g., a portion of a length of) the dipole branches 306 are non-conductive. In particular, the dipole branches 306 may have non-conductive extensions at their respective distal ends. Additionally or alternatively, the spacers 406 and/or the cable 408 may be non-conductive.

Figure 5:
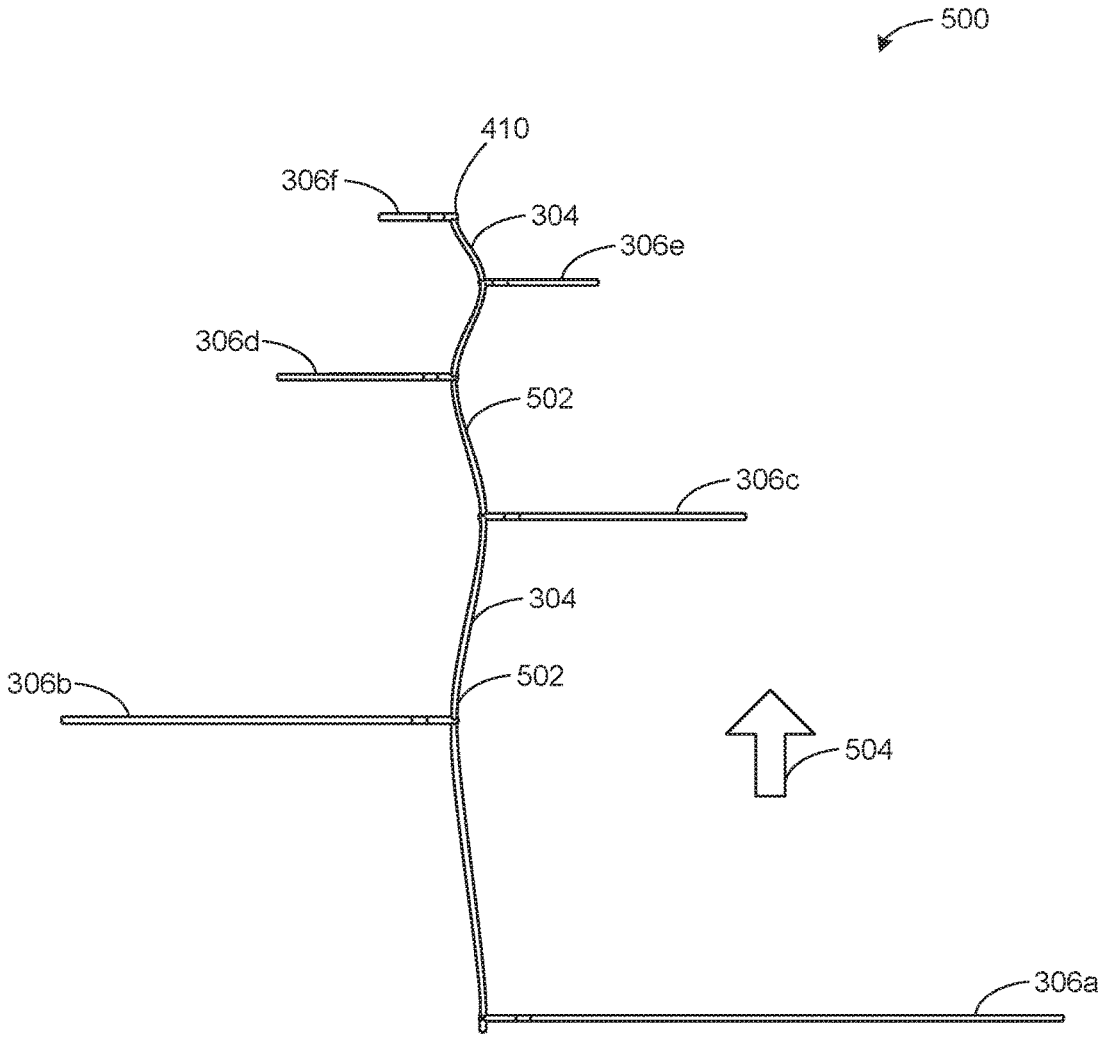
FIG. 5 depicts a single communication branch of the example dipole array antenna of FIGS. 3 and 4.

FIG. 5 depicts a single communication branch 500 of the example dipole array antenna 300 of FIGS. 3 and 4. According to the illustrated example, the single transmission branch 500 includes the helical communication line 304 as well as the associated dipole branches 306*a*-306*f*. As can be seen in the view of FIG. 5, the helical communication line 304 exhibits curves or contours 502.

In this example, the contours 502 vary in overall size along the length of the support 301 in a direction generally indicated by an arrow 504. In particular, curves of the contours (e.g., curve heights, etc.) 502 become smaller (e.g., gradually decrease) toward the distal end 410 of the helical communication line 304. Further, spacing between the dipole branches 306 as well as dipole branch length both decrease towards the distal end 410 of the helical communication line 304. In other words, pitch between the dipole branches 306 decreases towards the distal end 410 of the dipole array antenna 300. In some examples, shapes of the contours 502 vary towards the distal end 410 (e.g. the contours 502 become more pronounced proximate the distal end 410 of the dipole array antenna 300).

Figure 6:
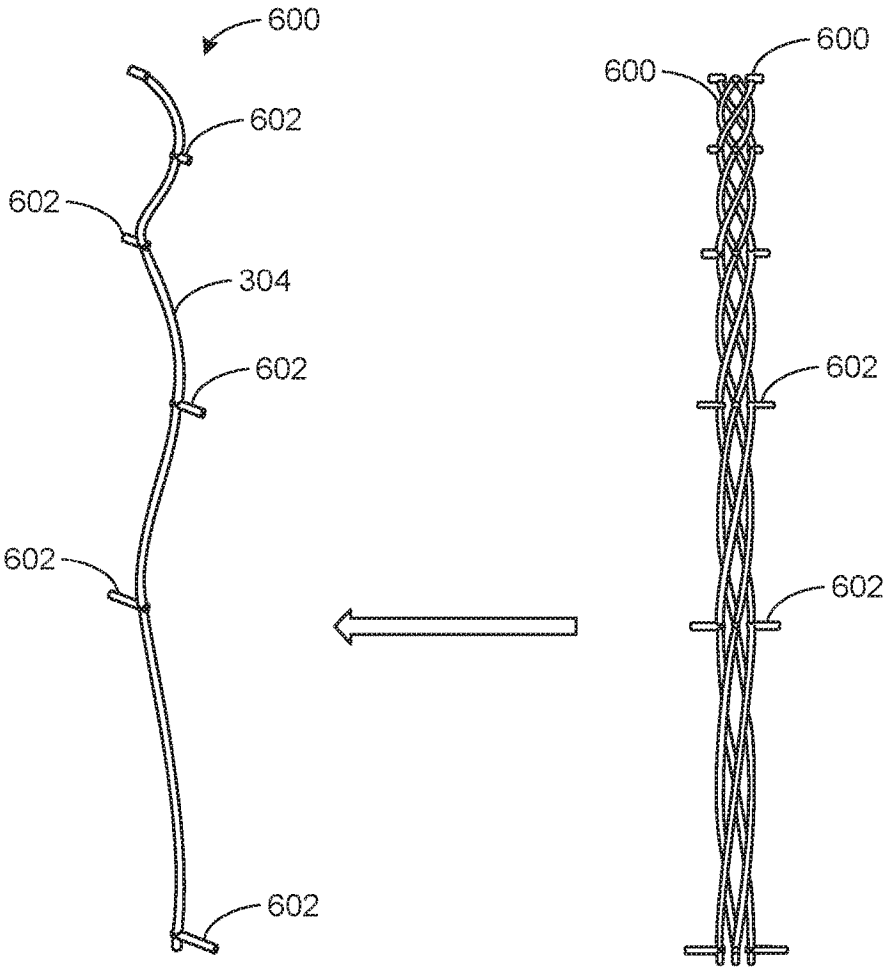
FIG. 6 depicts a single example helical communication line of the example dipole array antenna of FIGS. 3-5 and in relationship to multiple helical communication lines placed together.

FIG. 6 depicts the single example helical communication line 304 of the example dipole array antenna 300 of FIGS. 3-5. Further, FIG. 6 also depicts the helical communication line 304 in relationship to multiple helical communication lines 304 placed (e.g., intertwined) together. In the illustrated view of FIG. 6, the dipole branches 306 are not shown for clarity. In this example, the helical communication lines 304 include and/or are coupled to attachment protrusions 602 to which the respective dipole branches 306 are attached/coupled. In some examples, the protrusions 602 are part of the respective dipole branches 306. In these particular examples, the hinge 402 is placed and/or spliced between portions of the dipole branches 306. In some other examples, the hinge 402 is placed directly between the helical communication line 304 and the corresponding dipole branch 306 (e.g., the protrusion 602 is not disposed between the communication line 304 and the dipole branch 306).

As can be seen in FIG. 6, when multiple communication lines 304 are arranged and/or intertwined together, the protrusions 602 are accordingly spatially defined to be relatively perpendicular/orthogonal to one another (e.g., the attachment protrusions 602 at the positions along the length of the dipole array antenna 300 are relatively perpendicular to one another) while some of the attachment protrusions 602 are diametrically opposed to one another.

Figure 7A:
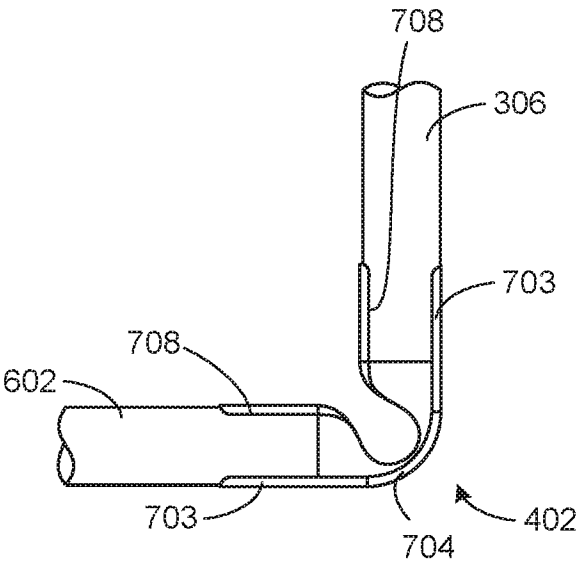
FIG. 7A is a detailed view of an example hinge of the example dipole array antenna of FIGS. 3-5 shown in a stowed or folded state.

FIG. 7A is a detailed view the example hinge or joint (e.g., foldable joint, rotation joint, etc.) 402 of the example dipole array antenna 300 of FIGS. 3-5 shown in a stowed or folded state. According to the illustrated example of FIG. 7A, the hinge 402 couples the attachment protrusion 602 and the respective dipole branch 306 together.

According to the illustrated example, the hinge 402 is implemented as a leaf spring and is at least partially composed of a metallic material (e.g., a beryllium copper alloy). The example hinge 402 includes sleeves 703, and a folding portion. In this example, the hinge 402 has an approximate resistance between the sleeves 703 of less than 0.5 ohms.

To couple the protrusion 602 and the dipole branch 306 to the hinge 402, the example hinge 402 includes the sleeves 703 having a relatively cylindrical overall shape and/or cylinder-like shape. In particular, the relatively cylindrical shape of each of the sleeves 703 allows respective cylindrical portions of the protrusion 602 and the dipole branch 306 to be received. In some examples, at least one of the dipole branch 306 or the protrusion 602 is/are placed into the respective sleeve 703 via an interference fit. Additionally or alternatively, the sleeves 703 may have slits 708 to facilitate insertion and/or placement of corresponding inserted and/or matably received components by enabling expansion of the sleeves along a diametric direction.

Figure 7B:
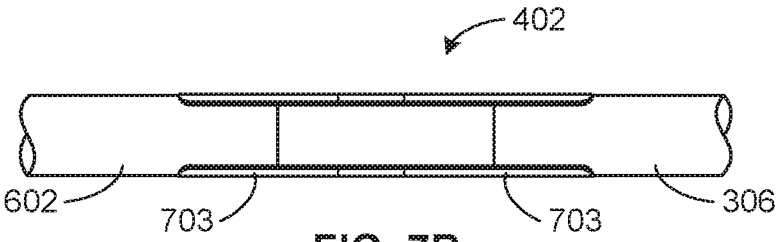
FIG. 7B is a detailed view of the example hinge of FIG. 7A, but in a deployed or unfolded state.

FIG. 7B is a detailed view of the example hinge 402, but in a deployed or unfolded state. According to the illustrated example of FIG. 7B, the protrusion 602 and the dipole branch 306 are diametrically opposed to one another when the hinge 402 is in the unfolded state. In some examples, the example hinge 402 remains in the unfolded state when there is a relatively low amount of force applied (e.g., no force applied) to the sleeves 703 and/or the hinge 402. In other words, in such examples, the hinge 402 returns and/or defaults to the unfolded or relatively strain-free state until a force is applied to fold the dipole branch 306 relative to the protrusion 602 (e.g., a default unfolded configuration).

Figure 8:
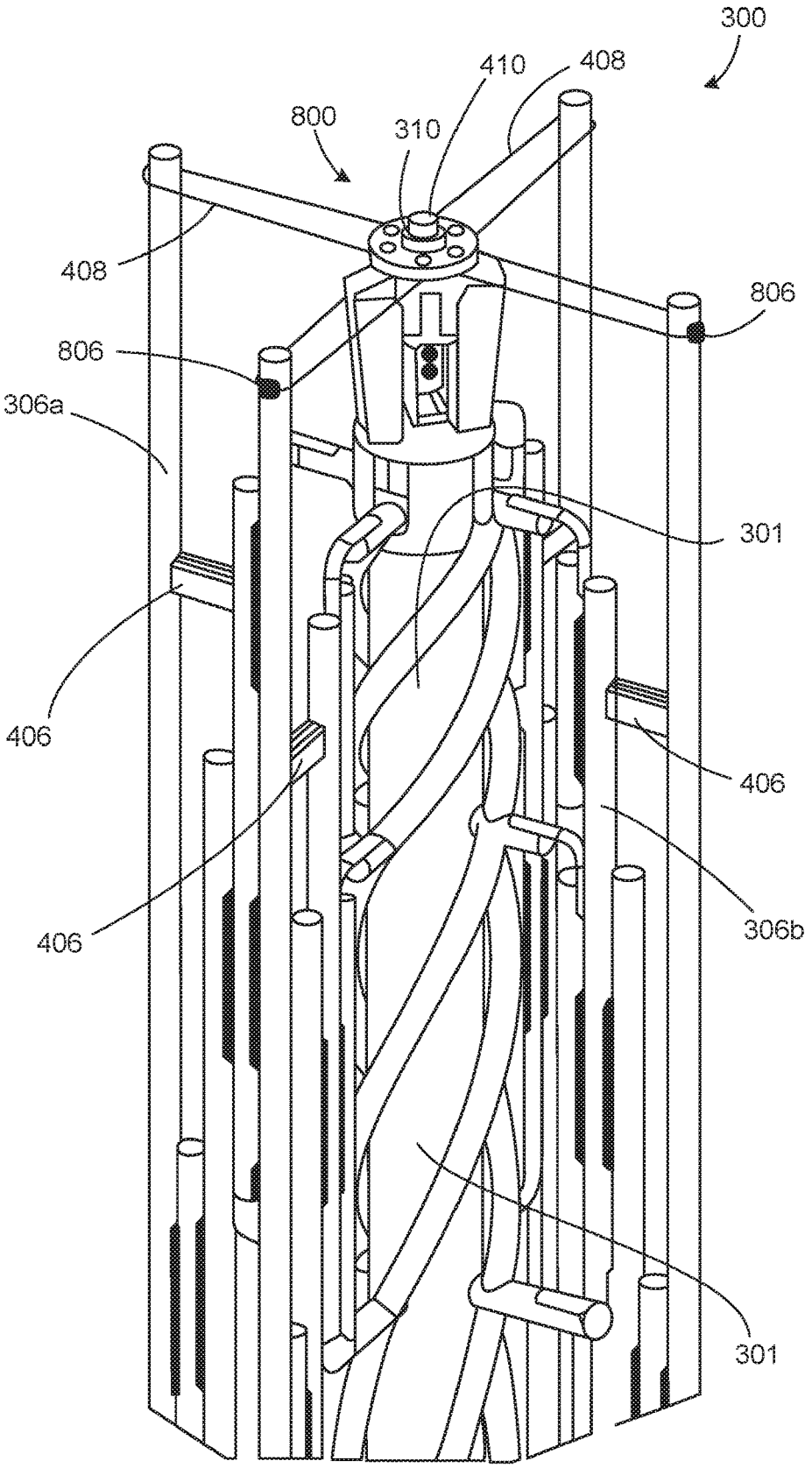
FIG. 8 is a detailed partial view of an example movement assembly that may be implemented in the examples disclosed herein.

FIG. 8 is a detailed partial view of an example movement assembly (e.g., a restraint assembly, a restraint system, an actuation system, a deployment system, a release device, etc.) 800 that may be implemented in the examples disclosed herein. The movement assembly 800 of the illustrated example includes the cables 408, and the movement device 310 that is coupled to the distal end 410 of the support 301. In this example, the cables 408 are coupled to respective ones of the dipole branches 306 (e.g., 306*a*, 306*b*, etc.) at points 806. As mentioned above in connection with FIG. 4, in some examples, the spacers 406 may be coupled to the dipole branches 306*a* to control movement of the dipole branches 306*b* that may, in turn, restrict movement of the other dipole branches 306*c*, and so forth.

To transition the dipole array antenna 300 between deployed and un-deployed states, the movement device 310 allows the cables 408 to move relative to the support 301, thereby causing the dipole branches 306 to rotate relative to (e.g., away from or towards) the support 301. In particular, the dipole branches 306 are folded upward (in the view of FIG. 8) with the cables 408 in tension until the movement device 310 allows the cables 408 to extend away from the support 301 by way of the hinges 402, thereby moving the dipole branches 306 to their respective default un-folded states. In some other examples, the cables 408 only wrap around a periphery of the respective dipole branch 306 (e.g., without being directly coupled to the respective dipole branch 306).

In other examples, the movement device 310 causes the dipole branches 306 to fold away from the support 301 (e.g., the movement device pushes the dipole branches away from the support 301). In such examples, the hinges 402 may have a default folded state and/or relatively stiff structures such as a rod or linkage, for example, may be used instead of the cables 408.

Figure 9:
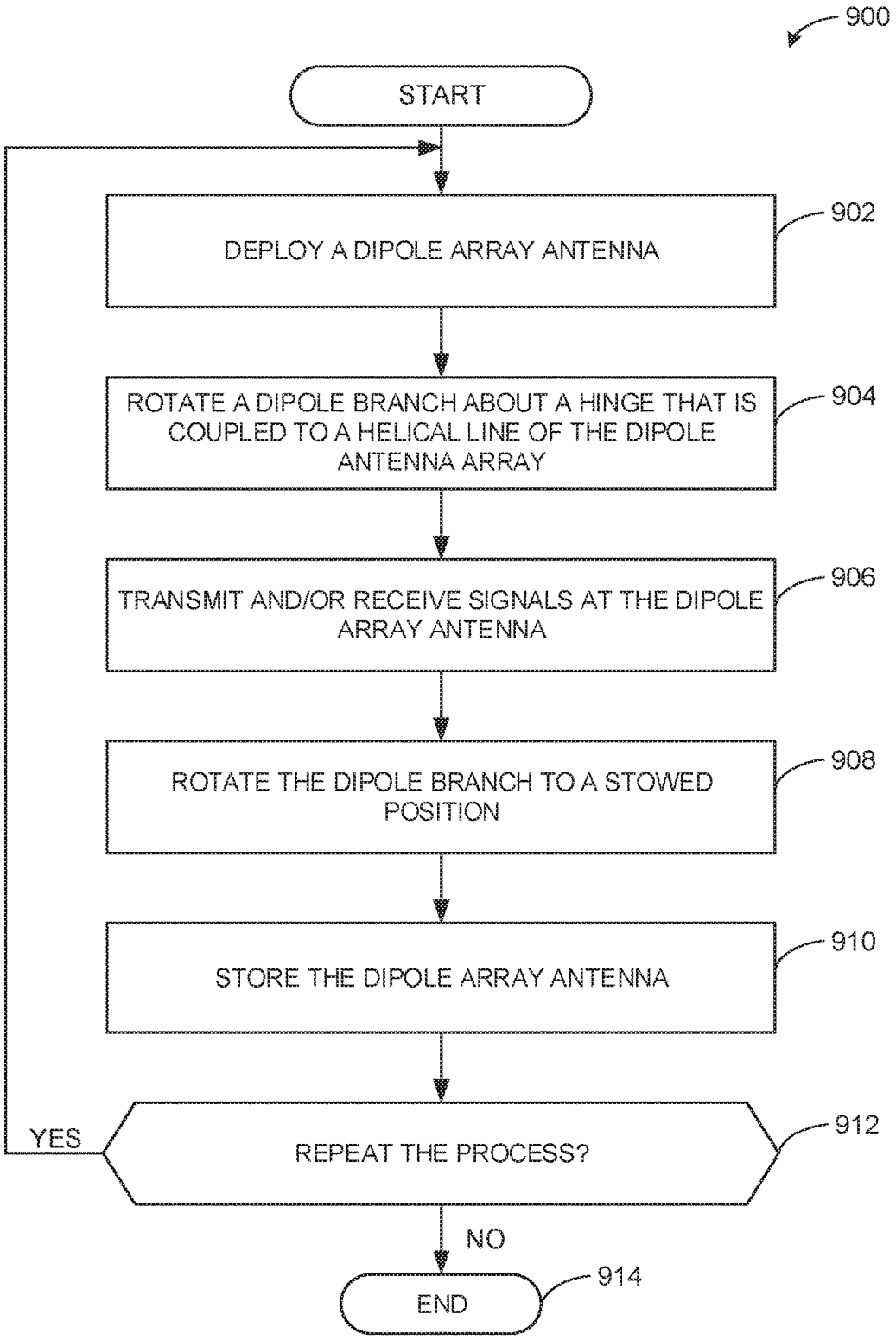
FIG. 9 is a flowchart representative of an example method that may be implemented to implement the examples disclosed herein.

FIG. 9 is a flowchart representative of an example method 900 that may be used to implement the examples disclosed herein. The example method 900 begins as the example dipole array antenna 300 implemented in the satellite 100 is to be deployed to transmit and/or receive signals.

The dipole array antenna 300 is deployed (block 902). According to the illustrated example, the dipole array antenna 300 is deployed from an internal storage of the satellite 100 with the dipole branches 306 folded towards the support 301.

The dipole branch 306 is rotated (e.g., folded) about the hinge/joint 402 that is coupled to the helical communication line 304, thereby deploying the dipole branch 306 (block 904). In particular, the movement assembly 800 releases and/or allows the cable 408 to extend away from the movement device 310, thereby causing the dipole branch 306 to extend laterally based on a natural resting position of the hinges 402.

Next, signals are transmitted and/or received at the dipole array antenna 300 (block 906).

According to the illustrated example, the dipole branch 306 is rotated about the hinge 402 to a stored/stowed position (block 908). In this example, the movement device 310 causes the cables 408 to retract the dipole branch 306 after the communication signals are transmitted and/or received.

Next, the dipole array antenna 300 is stored or stowed (block 910). In particular, the dipole array antenna 300 is stowed into the aforementioned internal storage of the satellite 100 with at least one dipole branches 306 in the stowed position.

Next, it is determined whether to repeat the process (block 912). If the process is to be repeated (block 912), control of the process returns to block 902. Otherwise, the process ends. This determination may occur based on whether the dipole array antenna 300 is needed to transmit and/or receive signals.

From the foregoing, it will be appreciated that the above disclosed methods, apparatus and articles of manufacture enable a cost-effective and reliable antenna array structure that can improve RF performance by providing accurate alignment of opposing dipole branches while also allowing compact folding and/or storage of the antenna array.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent. While the examples disclosed herein are shown related to satellites, the examples disclosed herein may be applied to any appropriate type of antenna, foldable antenna, dipole antenna application (e.g., a non-satellite antenna or antenna array, etc.), or any appropriate application involving folded elements or arms (e.g., non-antenna applications or use).

What is claimed is:

1. An apparatus comprising:

a helical communication line of a dipole array antenna;

a plurality of diametrically opposed protrusions extending laterally from the helical communication line and spaced along the helical communication line;

a plurality of hinges operatively coupled to respective ones of the protrusions; and dipole branches operatively coupled to respective ones of the hinges, wherein the dipole branches are to be moved, at the hinges, between deployed and un-deployed states.

2. The apparatus as defined in claim 1, further including a movement device to fold the dipole branches at the hinges.

3. The apparatus as defined in claim 2, wherein the movement device includes cables that are operatively coupled to the dipole branches.

4. The apparatus as defined in claim 3, wherein a default relaxed state of the hinges causes the dipole branches to be in the deployed state, and wherein the movement device extends the cables to deploy the dipole branches.

5. The apparatus as defined in claim 1, further including a central support, wherein the helical communication line at least partially surrounds the central support.

6. The apparatus as defined in claim 5, wherein the helical communication line is printed onto the central support.

7. The apparatus as defined in claim 1, wherein the hinges include tape spring hinges.

8. The apparatus as defined in claim 7, wherein the tape spring hinges include a default relaxed state that defines the deployed state of the dipole branches, and wherein the tape spring hinges are folded by a movement device.

9. The apparatus as defined in claim 1, wherein the dipole branches are spring-biased towards an unfolded position corresponding to the deployed state.

10. The apparatus as defined in claim 1, wherein the dipole branches include:

a first set of dipole branches proximate an end of the helical communication line, the end associated with a base of the helical communication line, the first set of dipole branches having a first length; and a second set of dipole branches positioned away from the end of the helical communication line, the second set of dipole branches having a second length shorter than the first length.

11. The apparatus as defined in claim 1, wherein the dipole branches extend perpendicularly from a longitudinal axis of the helical communication line.

12. A satellite comprising:

a dipole array antenna having intertwined helical communication lines surrounding a central support;

a plurality of diametrically opposed protrusions extending laterally from and spaced along respective ones of the helical communication lines;

a plurality of electrically conductive hinges operatively coupled to respective ones of the protrusions;

dipole branches operatively coupled to respective ones of the hinges; and a movement device to move, at the hinges, the dipole branches between deployed and un-deployed states.

13. The satellite as defined in claim 12, wherein the movement device includes a pyro-technic device.

14. The satellite as defined in claim 13, wherein the movement device includes cables that are operatively coupled to respective ones of the dipole branches.

15. The satellite as defined in claim 12, wherein the central support is at least partially composed of fiberglass.

16. The satellite as defined in claim 12, wherein the hinges include tape spring hinges.

17. A method comprising:

rotating a plurality of dipole branches about respective hinges to stow or deploy the dipole branches, the dipole branches operatively coupled to the respective hinges, the hinges operatively coupled to respective protrusions extending laterally from and spaced along a helical communication line of a dipole array antenna.

18. The method as defined in claim 17, further including storing the dipole array antenna after the dipole branches are stowed.

19. The method as defined in claim 17, wherein the hinges include tape spring hinges.

20. The method as defined in claim 19, wherein rotating the dipole branches includes moving the tape spring hinges away from a folded state.

21. The method as defined in claim 20, wherein at least one of the tape spring hinges is moved via cables of a movement device.

22. The method as defined in claim 17, wherein rotating the plurality of dipole branches includes controlling a cable operatively coupled to the dipole branches.

23. The method as defined in claim 17, further including transmitting or receiving signals via the helical communication line of the dipole array antenna.

24. The method as defined in claim 23, wherein rotating the dipole branches occurs prior to transmitting or receiving the signals.

25. The method as defined in claim 23, wherein the dipole array antenna extends from a satellite.

26. The method as defined in claim 23, wherein rotating the dipole branches occurs after transmitting or receiving the signals.

* * * * *